United States Patent [19]

Bunger

[11] 4,137,809

[45] Feb. 6, 1979

[54] ARPEGGIO SYSTEM FOR ELECTRONIC ORGANS

[75] Inventor: David A. Bunger, Cincinnati, Ohio

[73] Assignee: D. H. Baldwin Company, Cincinnati, Ohio

[21] Appl. No.: 567,354

[22] Filed: Apr. 11, 1975

Related U.S. Application Data

[63] Continuation of Ser. No. 102,874, Dec. 30, 1970, abandoned.

[51] Int. Cl.[2] ..... G10H 1/02; G10H 5/00

[52] U.S. Cl. ..... 84/1.03; 84/1.24; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,227,027 | 1/1966 | Von Gunten | 84/1.24 UX |
| 3,476,864 | 11/1969 | Munch, Jr. et al. | 84/1.03 |
| 3,480,718 | 11/1969 | Kohls et al. | 84/1.01 |
| 3,546,355 | 12/1970 | Maynard | 84/1.03 |
| 3,548,066 | 12/1970 | Freeman | 84/1.03 |
| 3,549,777 | 12/1970 | Bunger | 84/1.03 |
| 3,549,778 | 12/1970 | Munch, Jr. | 84/1.03 |
| 3,567,838 | 3/1971 | Tennes et al. | 84/1.01 |
| 3,617,602 | 11/1971 | Kniepkamp | 84/1.17 |

*Primary Examiner*—Stanley J. Witkowski
*Attorney, Agent, or Firm*—Kirkland & Ellis

[57] ABSTRACT

An arpeggiator for an electronic organ, comprising a source of ramp voltage having selectively a slowly ascending and a slowly descending section or only a slowly ascending section followed by a rapid reset, an accordion-like voltage divider for said ramp voltage consisting of a cascade of diodes, each calling forth one of a group of three tone signals when conductive, or no tone signal if short circuited, circuits for determining which diodes shall be conductive and which short circuited according to which keys of an organ are actuated, the ramp voltage peaking when all conductive diodes have been ascendingly scanned by the ramp voltage, each conductive diode when scanned by the ramp voltage falling forth a gating signal for one of the tone signals called for by the actuated keys, in orderly sequence of tone signals. The rates of ascent and descent of the ramp are controllable, and may at will cover all octaves of the organ higher than that encompassing actuated keys, or a limited range, including one, of octaves. The gates employed are arranged to provide piano like tones of variable sustain durations, and the ramp controlled circuitry may be disabled to enable a piano mode rather than an arpeggiation mode.

36 Claims, 7 Drawing Figures

INVENTOR
DAVID A. BUNGER

By W. N. Breunig Agent of
Hyman Hurwitz
ATTORNEY

INVENTOR
DAVID A. BUNGER
By W. N. Breunig Agent
Hyman Hurwitz
ATTORNEY

INVENTOR
DAVID A. BUNGER
W. H. Breuing
Agent
By Hyman Hurwitz
ATTORNEY

INVENTOR
DAVID A. BUNGER
W. H. Breunig
AGENT
By Hyman Hurwitz
ATTORNEYS

INVENTOR
DAVID A. BUNGER
W. N. Breunig
Agent
By Hyman Hurwitz
ATTORNEY

ARPEGGIO SYSTEM FOR ELECTRONIC ORGANS

This is a continuation of application Ser. No. 102,874, filed Dec. 30, 1970, and now abandoned.

BACKGROUND OF THE INVENTION

Various musical effects are achieved by the skilled organist, which the unskilled player cannot achieve. These include arpeggio effects, in which the organist rapidly ascends the keys of the organ, in any of a variety of fanciful sequences, or ascends and then descends. If the sequence covers a short range of notes the effect is called a strum, simulating the sound of a strummed guitar, so that a strum may be considered a short ascending arpeggio. Heretofore, it has not been possible to achieve strums or arpeggios automatically, in response to playing of one or more notes of a manual of an organ. The present invention provides automatic arpeggiation for the accompaniment manual of an electronic organ, and is believed to be a pioneer invention in this respect.

One problem faced in designing an arpeggiator is that there are sixty-one keys in the usual accompaniment manual, so that if all notes were to be controlled an extremely complex arpeggiator would result. According to the present invention, notes are grouped by threes, on the assumption that two or three notes of each trio will seldom be called forth simultaneously, so that each trio can be treated as one note for purposes of arpeggiation. The arpeggiator is thus required to deal with only twenty note positions, one of these accommodating four notes instead of three.

Trios of tone gates are turned on individually by key switches, as is usual in an organ, but each group of three tone signal gates controls one further gate which is arranged for wave shaping to produce piano-like tones. The latter gates are called pulse gates, and the key switch controlled gates are called key gates. The key gates are short sustain gates, and the pulse gates are long sustain linear gates.

SUMMARY OF THE INVENTION

An arpeggiator for an electronic organ, wherein playing of a key or a plurality of keys of a manual results in playing an arpeggio (1) up and down, or (2) up only, the arpeggio including all notes corresponding with the played keys. In the alternative, the arpeggio may extend in one sense over one octave, to simulate a strumming sound, or the arpeggiator may be disabled to enable a piano mode type operation.

DESCRIPTION OF THE PREFERRED EMBODIMENTS

FIGURE 1

Figure 1:
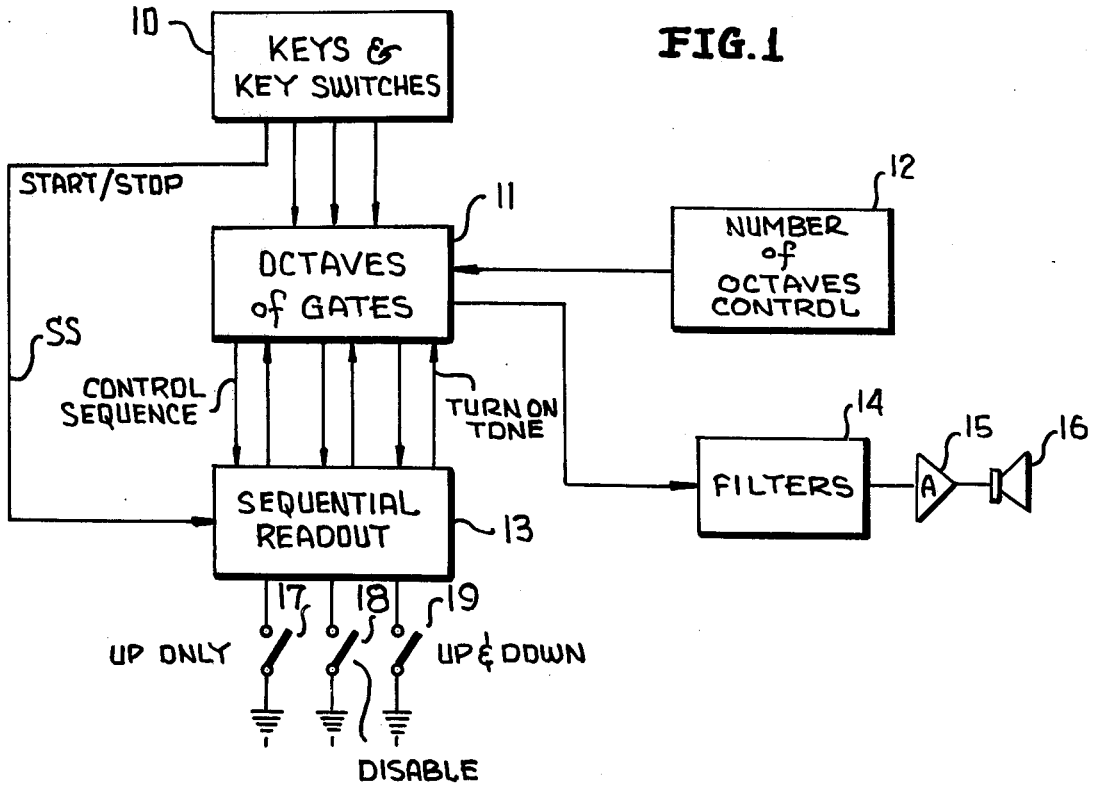
FIG. 1 is a broad scale block diagram of the system of the invention.

In FIG. 1, 10 represents the keys and key switches of a manual of the organ, usually the accompaniment manual. The key switches turn on gates 11, one gate per note, but in turning on a gate for one note the gates of all octavely related notes can also be turned on or activated, so that, for example if C2 is turned on, all higher C's are also actuated. The latter feature can be defeated at will by a number of octaves control, 12, which when activated assures that only that octave of gates is active within which a key is depressed. Now if the C2 key is actuated, only the C2 gate is rendered conductive.

When any key is actuated a control pulse is transferred via start-stop lead SS to a sequential readout 13, which reads out all activated gates in sequence, regardless of how many there are, within limits. Twenty-one readouts are available, but these are available for any combination of twenty gates, over the entire keyboard. The readout scans the gates which pass tones, regardless of which these are, maintaining the order of scanning in terms of note nomenclature so that all notes are scanned up in order of increasing frequencies, and down in order of decreasing frequencies.

The gates 11 lead to tone color filters 14, amplifier 15 and loudspeaker 16.

The sequential readout 13 can scan selected gates, proceeding up until the entire array of selected gates has been scanned and then be rapidly reset and restarted, in an "up only" mode. Reset occurs in response to closure of switch 17 and restart of the scan is then called for if any key is actuated.

Sequential readout can be totally disabled, by closure of switch 18, which leads to the so-called piano mode, i.e. any chord played is sounded as a chord, rather than as an arpeggio. Or, on closure of switch 19, the arpeggio goes up and then down, in an "up-down" mode, at the same rate up as down. If the number of octaves is set at one by control 12, and the rate of arpeggiation is rapid and in one direction only, the effect of a strumming guitar is achieved.

Further novel musical effects are achieved if keys are released in the course of an arpeggio or if new keys are actuated during an arpeggio.

The gates employed may be variable sustain gates, controllable by the musician. If sustain is sufficiently long, an arpeggio may be completed before the first of its notes has completely died away. If sustain time is short, the arpeggio will be staccato. The time required to complete an arpeggio is controllable at will.

FIG. 2

Key switches 10 are illustrated, and are labeled in respect to the notes called for. A positive voltage source 20 proceeds via a "note played detector" 21, common to all the key switches 10. The note played detector 21 provides a control voltage on lead 22 regardless of which key or keys 10 is or are actuated, so at least one is actuated, and this voltage is applied to sequential readout 13, to initiate its operation.

Each key has a key gate, as 23, for C2, 24 for C2#and each key gate is connected to a tone signal source, as 25 for C2, which is of appropriate frequency, and of square wave character in the usual case. These key gates 23, 24 etc are all short sustain gates, to enable staccato piano simulation. Long sustain piano effects are achieved by connecting a long sustain gate in cascade with each short sustain gate, as in U.S. patent application Ser. No. 788,868 filed Jan. 3, 1969, now issued as U.S. Pat. No. 3,549,779, issued Dec. 22, 1970 in the name of David A. Bunger and assigned to the assignee of this application.

To effect economies in construction, it is assumed that of any group of three adjacent notes, starting with C2, only one will ever be played at any one time. Therefore, all C switches of a manual connect to a bus 30, all C#switches to a bus 31 and all D switches to a bus 32, in each case via an isolating resistance 34. There are therefore four sets of three busses per set to cover all the octaves and all the notes of spatially distributed each octave, each octave being divided into four sets of three adjacent notes per set. Only one set of busses is illustrated. There thus is provided a C bus, to which all Cs are connected, a C#bus to which all C#s are connected, and so on, and it is these busses, rather than the key switches that are connected to key on the key gates, as C2, C2#, D2. The latter set has its outputs tied together at a common output terminal 35, and the output terminals lead to common pulse gates 36, 37, 38, 39 etc. which have long sustain capability. The latter four pulse gates cover the first octave, but each octave has its set of four pulse gates. A total of twelve pulse gates is illustrated, but to cover an organ keyboard of 61 notes, twenty pulse gates are employed, the highest frequency pulse gate collecting signal from four, instead of the usual three, key gates. All the pulse gates of the system lead to a common bus 40, which in turn proceeds to tab selected tone filters 14, conventional in electronic organs. The filters lead to amplifier 15 and loudspeaker 16. The pulse gates are turned on or read out in sequence by sequential readout 13, for the arpeggio mode of the system, or for the strum mode, in which a guitar is simulated. If the piano mode is desired, sequential readout is disabled and all energized pulse gates enabled simultaneously, by means not shown in FIG. 2. However, the readout is so accomplished that only pulse gates which pass tones are read out, or scanned, and the others are skipped.

The sequential readout has a limited number of readout positions, specifically 20, there being one readout position for each of pulse gates 36, 37, etc. Each readout position is enabled or disabled, according to a control voltage on each of leads 45, 46, etc. which proceed each from a group of three key switches, as C2, C2#, D. If a position is enabled it is read out in sequence, but if not it is skipped so that any called for notes can be read out in orderly note sequence regardless of how randomly it may be positioned in the array of all possible notes. The speed of readout can be controlled at will. This readout controls and effects arpeggiation.

The busses 30, 31, 32 are divided into octave sections by series diodes 51 and shunt diodes 53. For example, the C bus starts with the C2 switch 10, and proceeds via a resistance 50, and a series diode 51, conductively poled, to the C3 switch, which in turn proceeds similarly to the C4 switch, and so on. The anode of diode 51 is connected via a shunt diode 53, to a bus 54. Every series diode is provided with a shunt diode connected to the same bus 54. If bus 54 floats, the shunt diodes 53 are totally ineffective and the series diodes as 51, are conductive, and all notes of the same nomenclature are then represented on bus 30 whenever a note in the lowermost or 2 octave is called forth. However, if a note is the "3" octave is called for, the diode 51 acts to isolate the "2" octave gates, because of the polarity of diode 51. Therefore, all notes of a given nomenclature, called for by an actuated key, for all octaves above that key, are simultaneously gated on by the key, but no notes of that nomenclature in lower octaves are gated on.

If the cathodes of shunt diodes 53 are grounded, by grounding bus 54, at switch 12, no octaves are gated on which are higher or lower than the octave being played in, since a series diode isolates the lower octaves, and a shunt diode isolates the higher octaves. However, a player can play a chord spanning two octaves, and all played notes will be heard together, either in the piano mode if that is called for, or sequentially in either of the remaining modes, "up only" or "down only" as called for, by switches 17, 18, 19 (FIG. 1).

It is evident that separate controls could have been provided for each separate set of three shunt diodes 53, if desired, and also that the sequential readout could have been provided for each key gate, if desired, instead of for each set of three. The design actually selected presents a compromise between cost or complexity, and performance, which is justified by musical and economic realities.

FIG. 3

10 is a typical keyswitch (FIG. 2) which connects a +16.V bus 61 via a current limiting resistance 62 to the anode of a diode 63, the cathode of which is connected to a short sustain capacitor C1. The voltage across the sustain capacitor C1 is appled via resistance 65 to the anode of a gating diode 66, the cathode of which is supplied with tone signal from a square wave oscillator 67. The latter has a positive going wave shape 68 so that diode 66 is normally non-conductive. Upon application of positive voltage from capacitor C1 diode 66 alternately shunts and blocks current flowing through resistor 65 to signal bus 70, in response to tone signal. C2 is a wave shaping capacitor and the time constant is such that C2 charges slowly via resistor 65 when diode 66 is blocked by a positive level of signal 68, and discharges rapidly via diode 66 when the signal 68 assumes a zero level. The result is a sawtooth wave 71 on signal bus 70. When key switch 10 is closed the time constant of resistance 62 and capacitor C1 smooths build up, aided by discharge via resistance 65 and diode 66, which cyclically occurs as the tone signal oscillates. When key switch 10 is opened, the charge of C1 dissipates gradually, providing a short sustain.

Figure 2:
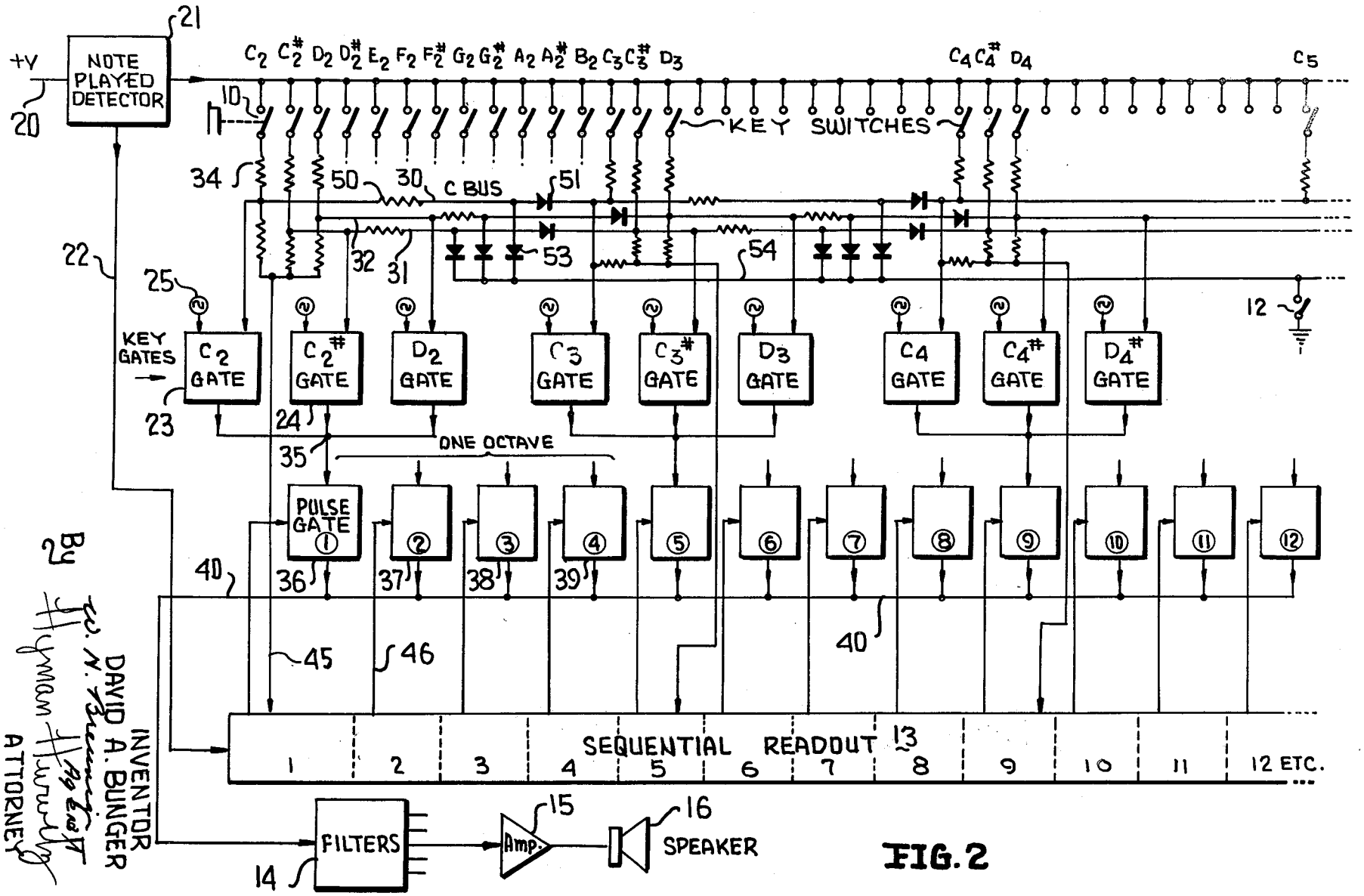
FIG. 2 is a block diagram expanding the block diagram of FIG. 1.

Bus 70 collects tone from three tone oscillators, controlled by three note-adjacent diode key gates, as is indicated in FIG. 2. It is assumed that only one key switch 10 of the three note group will be operative at any one time, in normal playing.

The signal appearing at terminal 35 of bus 70 is applied to the input of a linear diode long sustain gate, hereinabove called a pulse gate. Essentially this gate is constituted of two series diodes 73, 74, connected anode to anode by a capacitor 75. Gating voltage is separately applied to the anodes of diodes 73, 74 via resistances (1 m) 76, 77. The cathode of diode 73 is directly connected to terminal 35, carrying sawtooth tone signal from bus 70. The cathode of diode 74 is connected directly to output tone signal bus 40, which leads to tone color filters (see FIG. 2). There will be one pulse gate for each three key gates, all the pulse gates being connected to bus 40.

A long sustain capacitor C3 is connected via a resistance 80 (470K) to both resistances 76 and 77. This capacitor is connected via a diode 81 and a timing resistance 82 to a sustain bias bus 83, to which can be supplied adjustable sustain voltage for biasing off diode 81 after the voltage across C3 falls to the bias voltage during a gating cycle. After that time, then, the capacitor C3 can only discharge via the gate 36. Prior to that time C3 has two discharge paths. The gate therefore has a double rate of decay capability, rapid to a predetermined level, and thereafter very slow.

The capacitor C3 is charged when a tone is to be sounded from a 16.V bus 85 via a current limiting resistance 86 and a PNP transistor 87, normally off. Transistor 87 is turned on when both of transistors 88, 89 are turned on. These are connected in series to form an AND gate, the diode 90 providing isolation for positive voltage from the collector of transistor 89 to the emitter of transistor 88. Transistor 89 is turned on whenever a key switch is closed, since at that time voltage from lead 61 is applied to lead 91*a*. Transistor 88 is turned on by positive pulse signal incoming on lead 92 from point A.

FIG. 4

Figure 4:
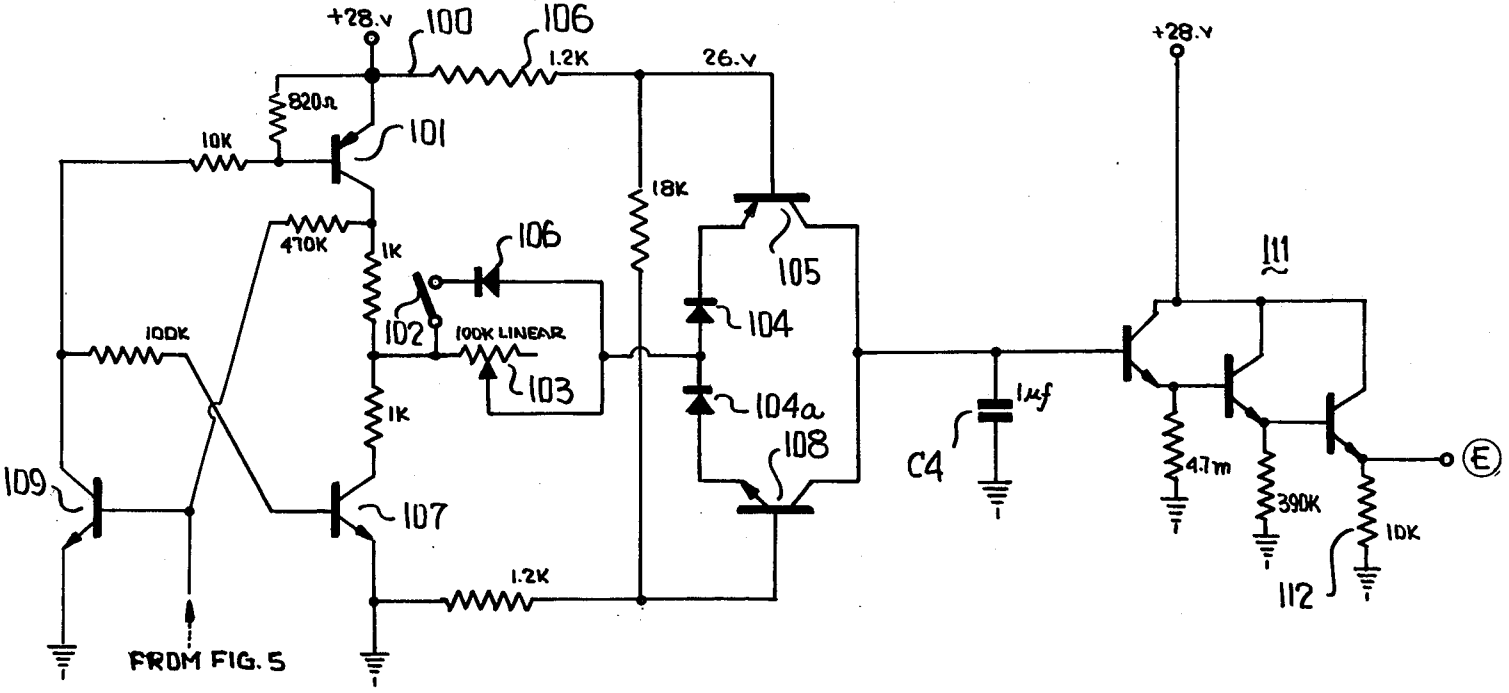
FIG. 4 is a circuit diagram of a ramp generator employed in the system of FIG. 2, forming part of a sequential readout.

We have hereinabove mentioned provision of a sequential readout (FIG. 2). Various forms of such a device may be envisaged, but the preferred form herein involves a ramp generator, and pick-offs responsive to attainment of predetermined voltage points along the ramp. FIG. 4 illustrates a ramp generator.

Referring first to FIG. 4, voltage from bus 100, at +28.V. is applied via PNP transistor 101 and adjustable resistance 103 (switch 102 assumed open) to the junction of diodes 104, 104*a*. Thence a connection is provided via diode 104 to the emitter of PNP transistor 105, diode 104*a* being pole to block. The base of transistor 105 is connected to bus 100 via a small resistance 106, to provide 26.V, and the collector to a timing capacitor C4. Transistor 101 is a switch, but variable resistance 103 and transistor 105 provide an adjustable constant current source for C4, so that the latter charges linearly. A constant current source is provided via transistor 105 because that transistor operates with constant base current, so that transistor 105 provides a constant current at its collector to capacitor C4. Whether switch 102 is closed or not, charge of C4 must take place via variable resistance 103, which thus serves to establish a variable slope for a ramp voltage developed across C4.

If now transistor 101 is rendered non-conductive, but transistor 107 rendered conductive, C4 discharges via transistor 108, diode 104*a*, resistor 103, transistor 107 to ground. Rise and decay ramps are then identical, except that if switch 102 is closed resistance 103 is bypassed by diode 106 and decay is very rapid. Thus a one-sided or a two sided ramp is provided, according as 102 is open or closed.

Transistors 101, 107 are rendered alternately conductive by flip-flop action. A transistor 109 has its collector connected directly to the base of transistor 101 and its base to the collector of transistor 101. Transistor 107 has its base directly connected to the collector of transistor 109. If a positive pulse is applied to the base of 109, it becomes conductive, lowers the base voltage of transistor 101, rendering it conductive and grounding the base of transistor 107, rendering it non-conductive. The positive side of a ramp now develops at C4. If a negative voltage is applied to the base of transistor 109, the latter becomes non-conductive, rendering the base of 107 positive and transistor 107 conductive. At the same time the base of 101 goes positive cutting off the transistor. Capacitor C4 now decays, either slowly if switch 102 is open, or very rapidly if it is closed. The negative pulses which start the ramp down derive from a ramp top detector, FIG. 5.

Figure 5:
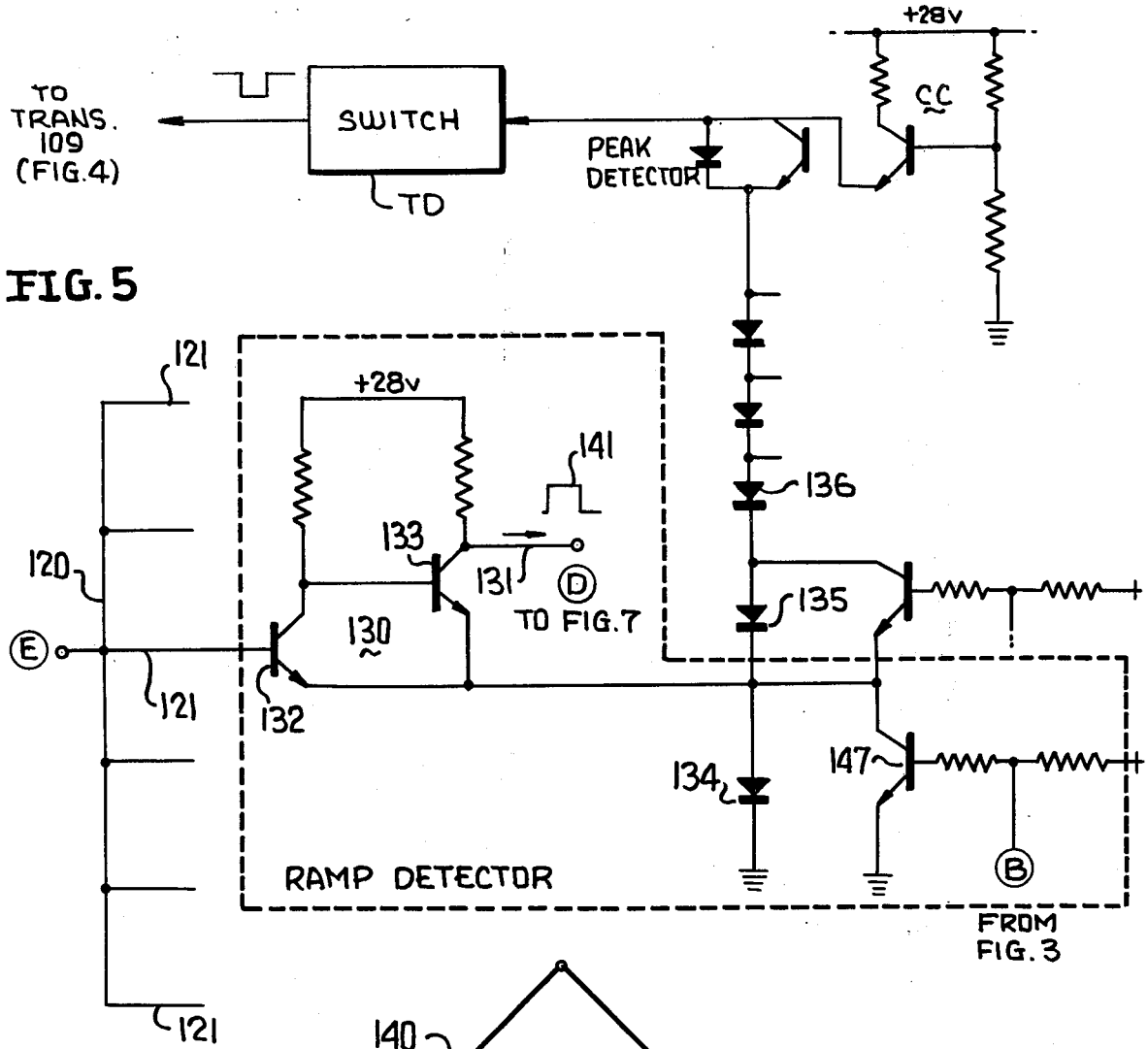
FIG. 5 is a block diagram of a ramp control and detector employed in the sequential readout of FIG. 2.

Referring now to FIG. 5, the height of the ramp is always precisely that required to arpeggiate all the notes called for by the player, since the total number of active diodes 134, 135, 136, etc. is equal to that number of notes, all the remaining diodes being shorted out of circuit. The ramp top detector TD represents a transistor switch which fires when the ramp height exceeds 0.5 V times the number of active diodes 134, 135, 136, etc. So, if three notes, say C2, E2, G2 are played, and if the system is operating in the arpeggio mode, fifteen diodes (5 × 3) are active, involving a ramp of 7.5 V. When that value is exceeded, i.e., when the voltage required by all non-shorted diodes 134, 135, 136 are exceeded by the ramp, a negative pulse is applied by detector TD to the base of transistor 109, to reverse the direction of the ramp. Had only a C2 note been called for, five diodes would be active, calling for a 2.5 V. ramp, and now when 2.5 V is exceeded, the ramp will reverse.

The voltage across capacitor C4 (FIG. 4) is taken off by an amplifier 111, which is highly isolative of capacitor C4 and provides its output across 10.K resistance 112 to point E. Amplifier 111 drains no appreciable current from capacitor C4, and may be considered solely voltage responsive.

Ramp voltage is applied to a bus 120, which connects with twenty-one pick-off leads 121, in the present embodiment. This allows five octaves of four notes per octave to be handled on sequential readout. Considering a typical case, a readout lead 121 extends to the base of a transistor switch 130, having an output terminal 131 (D). The emitters of the transistors 132, 133 constituting switch 130 are jointly connected to the anode of a diode 135, in this case having its cathode connected to ground. Diode 134 is one of a series chain of diodes 134, 135, 136; to the number of twenty-one diodes.

Figure 6:
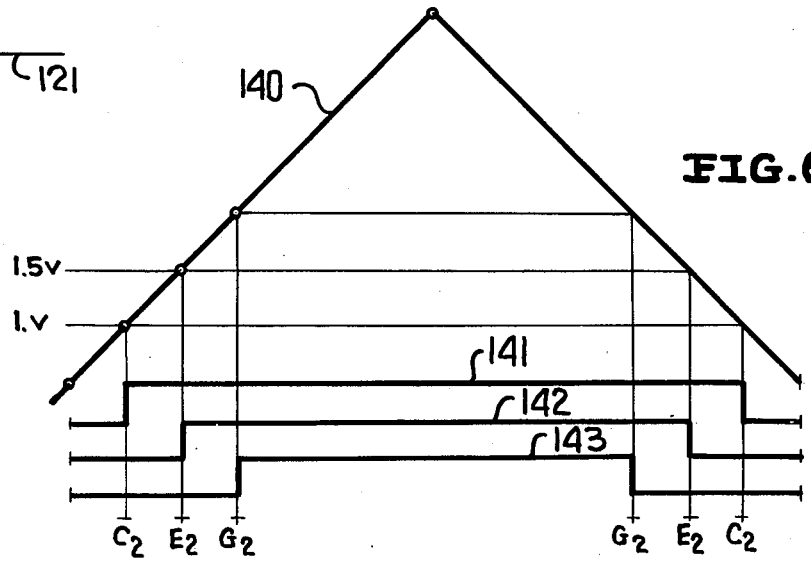
FIG. 6 is a wave form of a ramp voltage and the gating pulses derivable therefrom.

The diodes can be assumed to have each a voltage of 0.5V thereacross. Therefore the diodes represent an effective resistance chain. Assuming transistor 147 to be "off", the emitter of transistor 132 is then maintained ½ V. above ground, by the diode 134, and the base another ½ V. by the base-emitter diode of transistor 132. Therefore, when the ramp attains 1.V switch 130 will fire and it will remain fired until the ramp has achieved a like value on the way down. If in FIG. 6, 140 is the two-sided ramp, and if the notes C2, E2, G2 are played, a pulse or positive wave form 141 will be formed for C2, a pulse 142 will be formed for E2, and a pulse 143 will be formed for G2. The lengths of these pulses are not related to the notes played, as will now be explained, but rather to the position of the note in the set of arpeggiated notes called for by the player.

Figure 7:
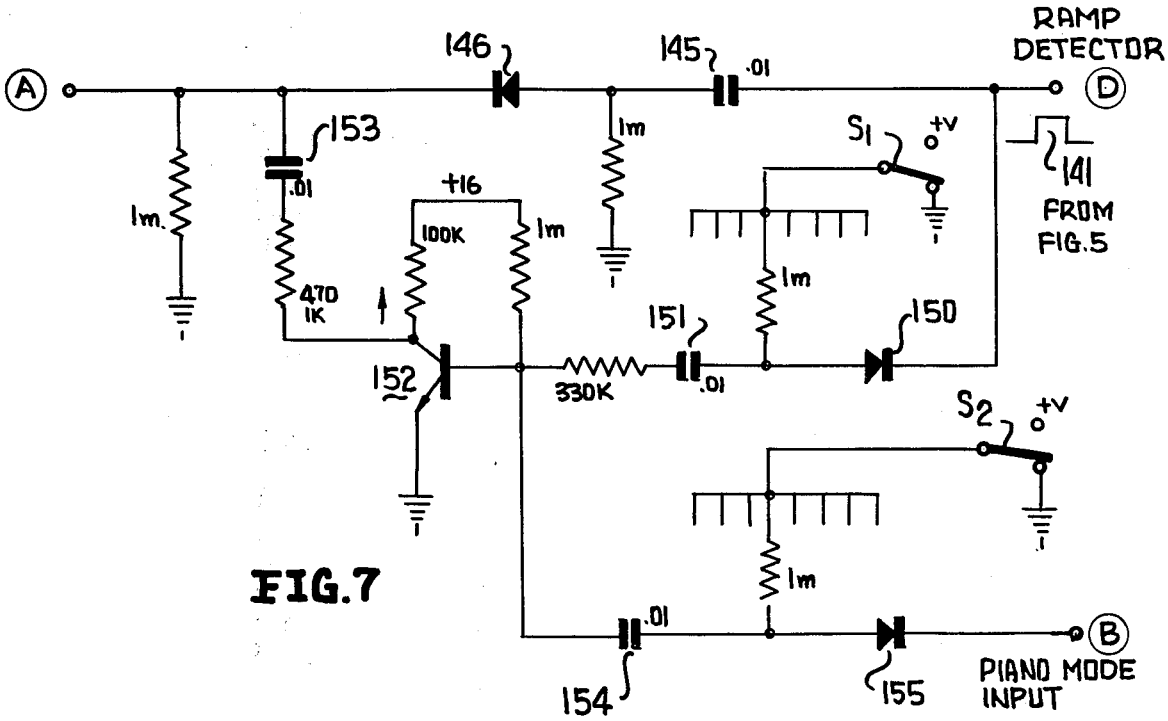
FIG. 7 is a circuit diagram of readout circuit for the gating pulses shown in FIG. 6.
Figure 3:
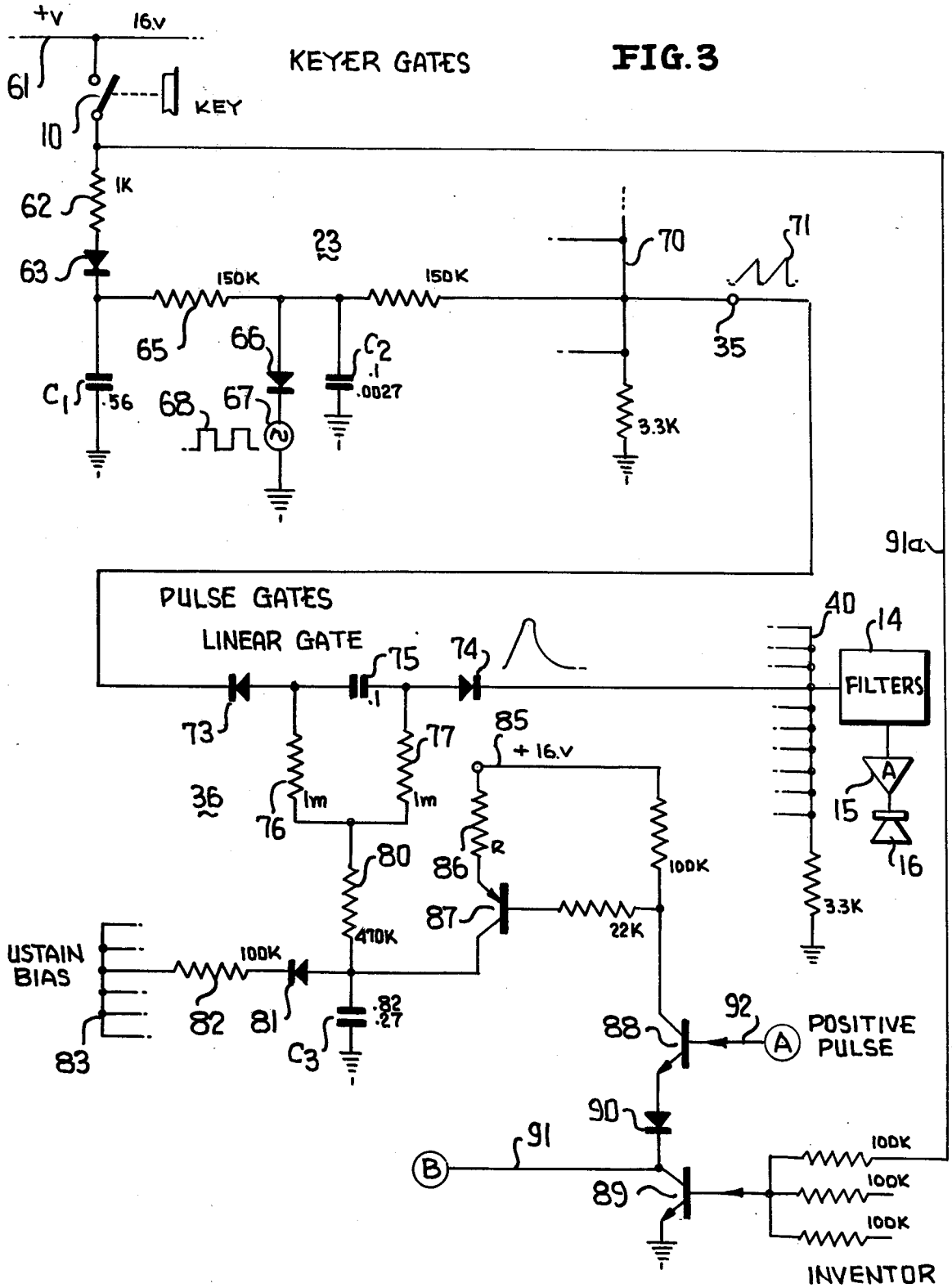
FIG. 3 is a circuit diagram of a typical gating system, employed in the system of FIG. 2, including a keyer gate, a pulse gate, and the direct controls for these.

Each of diodes 134, 135, 136, and so on to twenty diodes, is shunted by a transistor switch, normally on, so that its diode is short circuited. Whenever any played note is attained, by the ramp, is positive pulse, as 141 rises. That rise happening to correspond with C2 (in FIG. 6). That pulse is applied to terminal D of FIG. 7. The voltage rise of pulse 141 is passed through capacitor 145 and proceeds to terminal A (FIG. 7). From terminal A, the pulse is applied to the base of transistor 88 (FIG. 3) and turns it on, transiently. At the same time closure of key 10 has applied positive voltage to the base of transistor 89, and ground appears at terminal B, so long as the key is actuated. B is at this time a grounded terminal, and renders transistor 147, FIG. 5, non-conductive. The latter is normally conductive, shorting diode 134. Therefore, only diodes are in circuit which represent, or correspond with, a closed key switch, but all diodes which do not represent a closed key switch are shorted out of circuit. There is thus provided a series resistance chain which is of variable length, and has one resistance (a diode) for each group of three notes and notes octavely coupled thereto, and no resistance for each set of open keys and notes octavely coupled. When the ramp decays slowly, a voltage drop is generated for the same voltage position along the ramp as existed in rise, for any note, due to the shapes of pulses 141, 142, 143, and the voltage drop proceeds via diode 150, and capacitor 151, and a short pulse is thus transferred to the base of transistor 152, cutting off that transistor and raising the voltage of its collector. The rise is communicated as a short pulse via capacitor 153. Accordingly, a positive pulse occurs at A for each rise and each fall of the wave form 141.

The positive pulses at A turn on the transistor 88, and each turn on applies a gating pulse via transistor 87 to the storage capacitor C3, the voltage of which controls the conductivity of linear gate 36.

If switch S1 is grounded, the anode of diode 150 is grounded and no pulse is generated for negative going terminations of pulses 141, etc. This is appropriate for operation with a one sided ramp, but if the ramp is in fact two sided no sounds will occur on fall, with S1 grounded. A new rise can be started at any position of the silent fall, by reclosing a key switch. With S1 at +V the ramp is operative up and down, the diode 150 being biased conductive and being thus able to follow the pulses 141. Thereby a negative pulse is transferred to the base of 152, which opens and raises the voltage of its collector to transfer a pulse to terminal A.

Switch S2, when grounded prevents transfer of signals from terminal B. That terminal represents a key closure, so that if plural keys were closed, say C2, E2, G2, their corresponding transistors 89 would be closed. This represents the piano mode of playing, disabling by grounding switch S2. But if switch S2 is at +V each grounding of point B represents a negative pulse, formed as a short transient by capacitor 154 via diode 155, and cause generation of a gating signal at A.

The diode chain is supplied with heavy constant current, from transistor CC. That transistor operates with collector and base at a fixed voltage difference and therefore assures a fixed current flow. Thus is assured that any current drawn by the switches 130 will not affect the ramp.

What is claimed is:

1. A musical instrument comprising a generator means for producing a series of signals corresponding to a plurality of musical tones, a keyboard, a set of key-operable switches operable by the keys of said keyboard; a series of control gates for selectively interconnecting the key-operable switches in circuit with said generator means for producing tones in response to operation of said control gates, and scanning means for sequentially scanning in an up-down sequence said key-operated switches and for operating said control gates for a predetermined interval in response to operated ones of said key-operated switches.

2. The combination according to claim 1, wherein is provided means for relatively slowly scanning by said scanning means during scanning of operated ones of said keys and relatively rapidly scanning by said scanning means through unoperated ones of said keys.

3. Apparatus according to claim 1, including means connected with said control means for operating successive ones of said control gates with substantially no delay between the period during which one such gate is operated and the period in which the next successive gate is operated, relative to the duration of operation of each gate, whereby an arpeggio is produced with substantially no delay between successive tones of said arpeggio.

4. Apparatus according to claim 1, wherein said instrument includes means for generating periodic timing signals for controlling the timing of certain ones of said control gates, including timing means connected to receive said timing signals and for controlling the length of said pre-determined interval in response thereto.

5. A musical instrument comprising:

a. generator means for producing a series of signals corresponding to a plurality of musical tones;

b. a keyboard;

c. a set of key-operable switches operable by the keys of said keyboard;

d. a series of control gates connected with said switches and with said generator means for selectively interconnecting the key-operable switches in circuit with said generator means for producing tones in response to operation of said gates;

e. scanning means for sequentially scanning said key-operable switches and for sequentially selecting and operating said control gates in response to operated ones of said key-operable switches; and f. control means connected with said scanning means for temporarily preventing said scanning means from selecting another control gate for a predetermined interval each time an operated one of said key-operable switches is scanned.

6. Apparatus according to claim 5, wherein said scanning means comprises means for sequentially energizing a plurality of scanning lines, and circuit means interconnecting said scanning lines with said key-operable switches.

7. Apparatus according to claim 5, including means for connecting said key-operable switches with said gates, and means for connecting said scanning lines with said gates, whereby said gates are actuated in response to operation of said switches when their respective scanning lines are energized.

8. Apparatus according to claim 5, including an output system for producing musical tones in response to signals applied thereto, and a plurality of keyers connected with said output system and with said generator means for selectively connecting the signals from said generator to said output system, and means connecting said keyers individually with said control gates, said keyers being responsive to the operation of corresponding ones of said gates.

9. Apparatus according to claim 5, including a manually operable mode selector switch for selecting one of a plurality of operating modes of operation, said scanning means being connected with said mode selector switch and operable to scan said key-operable switches in one direction or in both in response to the condition of said switch.

10. An arpeggiator for an electronic organ, comprising means responsive to playing of a plurality of playing keys of said organ for generating a two-sided ramp voltage wage form having sides of equal slope, rising from a reference value to a peak value equal to a voltage increment times the number of said keys plus a fixed increment regardless of the number of said keys, and means responsive to achieving of each of said increments by said wave form for sounding a note corresponding with a different one of said keys.

11. An arpeggiator for an electronic organ, comprising a plurality of keys, said keys being grouped into adjacent groups of three keys, each of said groups of three keys having no duplications and no overlaps, respective gate means for each of said groups of three keys for transmitting tone signals corresponding to actuated ones of said three keys in response to control pulses, and sequential readout means for producing control pulses for causing said gate means to transmit tone signals corresponding to actuated ones of said keys in an up-down sequence established by a spatial distribution of said control pulses.

12. An arpeggio generator for an electronic organ, comprising an array of keys, means responsive solely to simultaneous actuation of any plurality of said keys from 2 to 5 for calling forth tones corresponding with all said plurality of said keys sequentially in an up-down sequence of equal time intervals and in increasing followed by decreasing orders of frequencies.

13. In an electronic organ, an array of keys corresponding with the notes of the musical scale, a source of spatially distributed sequential control pulses having a start point, means responsive to actuation of n keys simultaneously, where n is an integer, for generating said control pulses, means responsive to said control pulses for sounding tones corresponding with notes of the same nomenclature as actuated keys in an ordered time sequence of said tones, means responsive to attainment by said control pulses of a predetermined spatial position for causing said control pulses to reverse spatial direction and sequentially return to said start point so that tones corresponding with said actuated keys are sounded in an ordered up-down arpeggio sequence.

14. The combination according to claim 13, wherein said notes of the same nomenclature extend over plural octaves.

15. The combination according to claim 13, wherein the actuated keys are no greater than n while the notes of the same nomenclature extend to nm, where m is selected from among the integers 2, 3, 4, 5.

16. A musical instrument comprising a series of tone signal producing means having frequencies corresponding to a chromatic musical scale, a keyboard having a series of keys, a set of key switches actuatable by said series of keys, means responsive to actuated ones of said series of keys for providing keying potentials, a series of normally non-conductive key gates, respective ones of said gates being connected to corresponding ones of said series of tone signal producing means and respectively responsive to said keying potentials to render said key gates conductive of said tone signals, a plurality of control gates, respective ones of which are connected between said key gates and an output system, sequential readout means for successively applying pulses derived from said keying potentials to said control gates in a forward sequence, and switching means for initiating operation of said sequential readout means.

17. The combination according to claim 16, wherein said keying potentials correspond with notes of nomenclatures extending over at least one octave.

18. The combination according to claim 17, wherein is provided means for selecting the number of said octaves.

19. The combination according to claim 16, wherein is provided means for at will successively applying said pulses in either (a) only in a forward sequence to produce an up arpeggio, (b) in a forward sequence followed by a reverse sequence to produce an up arpeggio followed by a down arpeggio.

20. In an electronic organ, a source of a spatially distributed pulse train having a start point and positions corresponding to notes of the musical scale, a plurality of keys corresponding with distinct notes of the musical scale, means responsive to actuation of selected keys, including one key, for initiating said spatially distributed pulse train, means for terminating said pulse train at a position which is beyond the actuated keys, and means for sensing predetermined positions of said pulse train corresponding to actuated keys in an up-down time sequence, and means responsive to sensing of each of said positions corresponding to actuated keys for calling forth a sound.

21. In an electronic organ, an array of keys corresponding with notes of the musical scale, means responsive to actuation of a plurality of said keys for sounding tones corresponding with said keys in an ordered up-down sequence, said last means including a sequential readout operative to scan only all the notes called for by the actuated keys in said up-down sequence for a variable number of keys in said plurality.

22. In an electronic organ, an array of keys corresponding with notes of the musical scale, and means responsive to actuation of a plurality of said keys for sounding tones of nomenclatures corresponding with the nomenclatures of the actuated keys in an ordered up and thereafter down sequence, said last means including a sequential readout operative to scan all the notes of said nomenclature comprised in said organ in an up-down arpeggio sequence extending for at least one octave beyond notes called for by the actuated keys.

23. In an electronic organ, an array of keys corresponding with notes of the musical scale, means responsive to actuation of a plurality of keys for selectively (1) simultaneously sounding tones corresponding with said keys, (2) sounding tones of nomenclatures corresponding with the nomenclatures of the actuated keys in a unidirectional sequence only and (3) sounding tones of nomenclatures corresponding with the nomenclatures of the actuated keys in an up-down sequence, (1), (2) and (3) constituting diverse operating modes, said means including a sequential electronic readout.

24. The combination according to claim 23, wherein is included operator controlled switch means for selecting ones of said modes.

25. A musical instrument comprising:

a. generator means for producing a series of signals corresponding to a plurality of musical tones;
b. a keyboard;
c. a set of key-operable switches in circuit with said generator means for producing tones in response to operation of said key operable switches;
d. control gates responsive to operated ones of said key-operated switches;
e. scanning means for sequentially scanning said key-operable switches and for operating said control gates; and
f. control means connected with said scanning means for successively increasing the scanning time of said scanning means at operated ones of said key operated switches in comparison with the scanning time at unoperated ones of said key operated switches.

26. Apparatus according to claim 25, including means connected with said control means for operating successive ones of said control gates with substantially no delay between the period during which one such gate is operated and the period in which the next successive gate is operated, relative to the duration of operation of each gate, whereby an arpeggio is produced with substantially no delay between successive tones of said arpeggio.

27. In an electronic organ including at least two octaves of keys a plurality of keying circuits operated by the keys, tone generator means connected to respective ones of the keying circuits for generating tone signals corresponding to the notes of the at least two octaves of keys, and an electro-acoustic transducer, an arpeggio generator comprising:

scanning means for scanning the keying circuits in an up and then down arpeggio sequence in response to actuation of any of said keys;

gate means for transmitting tone signals from the operated keying circuits to the electro-acoustic transducer corresponding only to said actuated keys in an essentially evenly timed up-down arpeggio sequence in response to scanning by said scanning means.

28. An arpeggio generator as claimed in claim 27, further comprising octave control means for causing said gate means for transmitting to also transmit tone signals octavely related to said actuated keys in an essentially evenly timed up-down arpeggio sequence.

29. An arpeggio generator, as claimed in claim 27, further comprising means for adjusting equally the length of time between the beginnings of successive tone signals conducted to the electro-acoustic transducer.

30. In an electronic musical instrument including at least two octaves of keys corresponding to the notes of the musical scale, tone generator means for generating tone signals corresponding to the notes of the at least two octaves of keys, and an electro-acoustic transducer; a selectable arpeggiator comprising:

mode selector means for selecting between an up-down arpeggio mode, an up only arpeggio mode, and a conventional percussive mode;

scanning means for scanning said keys in response to actuation of any of the keys in an up and then down arpeggio sequence in response to said mode selector being in the up-down mode, in an up only arpeggio sequence in response to said mode selector being in the up only arpeggio mode;

disabling means for disabling said scanning means in response to said mode selector means being in the conventional percussion mode;

gating means for conducting to the electro-acoustic transducer said tone signals corresponding only to the actuated keys in an evenly timed arpeggio sequence in accordance with the selected arpeggio mode in response to scanning by said scanning means and when said disabling means disables said scanning means said tone signals corresponding to actuated key switches are transmitted to the electro-acoustic transducer simultaneously.

31. A selectable arpeggiator, as claimed in claim 30, further comprising octave control means for causing said gating means to also conduct tone signals octavely related to the actuated keys to the electro-acoustic transducer in an essentially evenly timed arpeggio sequence corresponding to the selected arpeggio mode.

32. A selectable arpeggiator, as claimed in claim 30, further comprising means for adjusting equally the length of time between beginnings of successive tone signals in a selected arpeggio sequence conducted to the electroacoustic transducer.

33. In an electronic musical instrument including a plurality of tone signal producing means having frequencies corresponding with a chromatic musical scale, a keyboard having a plurality of keys, a set of key switches actuatable by the plurality of keys, biasing means for providing keying potentials corresponding to actuated ones of the key switches, a plurality of keying circuits connected to respective ones of the tone signal producing means and respectively responsive to the keying potentials to conduct the corresponding tone signals, and an output system; an arpeggiator comprising:

a series of control gates connected between respective ones of the keying circuits and the output system;

sequential electronic readout means for successively rendering conductive those control gates associated with conductive ones of said keying circuits to pass tone signals corresponding with the actuated keys to the output system in an essentially evenly timed up-down arpeggio sequence.

34. An arpeggiator, as claimed in claim 33, wherein each of said control gates is connected to three adjacent keying circuits corresponding to three adjacent semitones of the chromatic musical scale.

35. An arpeggiator, as claimed in claim 33, further comprising means for causing octavely related ones of the keying circuits to be also rendered conductive in response to actuation of a corresponding key switch so that a multi-octave arpeggio sequence of tone signals is conducted to the output system.

36. An arpeggiator, as claimed in claim 33, further comprising means for adjusting equally the length of time between beginnings of successive tone signals associated with conductive ones of said keying circuits and conducted by the control gates to the output system.

* * * * *

UNITED STATES PATENT AND TRADEMARK OFFICE

CERTIFICATE OF CORRECTION

PATENT NO. : 4,137,809

DATED : February 6, 1979

INVENTOR(S) : David A. Bunger

It is certified that error appears in the above-identified patent and that said Letters Patent are hereby corrected as shown below:

Col. 3, line 43 - insert -- spatially distributed -- after "number of";

Col. 6, line 38 - "135" should be -- 134 --;

Col. 6, line 60 - "is positive" should be -- a positive --

Signed and Sealed this

*Eleventh* Day of *December 1979*

[SEAL]

*Attest:*

SIDNEY A. DIAMOND

*Attesting Officer*

*Commissioner of Patents and Trademarks*